US006263618B1

(12) United States Patent
Jones

(10) Patent No.: US 6,263,618 B1
(45) Date of Patent: Jul. 24, 2001

(54) RAIN GUTTER CLEANING ASSEMBLY

(76) Inventor: James H. Jones, #1 Ledgebrook, Winfield, KS (US) 67156

( * ) Notice: Subject to any disclaimer, the term of this patent is extended or adjusted under 35 U.S.C. 154(b) by 0 days.

(21) Appl. No.: 09/289,421

(22) Filed: Apr. 9, 1999

(51) Int. Cl.[7] ..... E04D 13/064
(52) U.S. Cl. ..... 52/12; 52/16; 210/459
(58) Field of Search ..... 52/11, 12, 16; 210/162, 459, 474, 477

(56) References Cited

U.S. PATENT DOCUMENTS

| | | | | |
|---|---|---|---|---|
| Re. 36,343 | * | 10/1999 | Silva | 52/12 X |
| 3,889,474 | * | 6/1975 | Frangmeier | 52/16 X |
| 4,247,397 | * | 1/1981 | Dobosi | 210/162 |
| 4,472,274 | * | 9/1984 | Williams | 210/459 X |
| 4,615,153 | * | 10/1986 | Carey | 52/12 |
| 4,798,028 | * | 1/1989 | Pinion | 52/16 |
| 4,801,377 | * | 1/1989 | Bolt | 52/12 X |
| 5,526,612 | * | 6/1996 | Wade | 52/12 |
| 5,678,360 | * | 10/1997 | Fort et al. | 52/12 X |
| 5,709,051 | * | 1/1998 | Mazziotti | 52/16 X |
| 5,755,061 | * | 5/1998 | Chen | 52/12 |
| 5,985,158 | * | 11/1999 | Tiderington | 52/12 X |

* cited by examiner

*Primary Examiner*—Carl D. Friedman
*Assistant Examiner*—Kevin D. Wilkens
(74) *Attorney, Agent, or Firm*—Michael S. Neustel

(57) ABSTRACT

A rain gutter cleaning assembly for removing leaves and other debris from a conventional rain gutter thereby allowing unobstructed drainage of water within the rain gutter. The inventive device includes a guide structure having an upper opening, a lower opening and a front opening. The upper opening of the guide structure mates with a gutter opening with the rain gutter. A plurality of prongs are positioned within the guide structure and are inclined toward the front opening and extend outwardly through the front opening a finite distance. A funnel structure is attachable to the lower opening of the guide structure for connecting to a conventional downspout. In operation, when leaves accumulate within the rain gutter the wind blows the dried leaves about the rain gutter. When the leaves approach the gutter opening, they fall through the guide structure and slide upon the plurality of prongs out through the front opening thereby not allowing the leaves to obstruct the downspout. During rainy conditions, the water within the rain gutter flows toward the gutter opening. As the water flows through the gutter opening it passes through the plurality of prongs into the downspout free of the debris that is separated from the water by the prongs.

19 Claims, 4 Drawing Sheets

RAIN GUTTER CLEANING ASSEMBLY

BACKGROUND OF THE INVENTION

1.Field of the Invention

The present invention relates generally to rain gutter devices and more specifically it relates to a rain gutter cleaning assembly for removing leaves and other debris from a conventional rain gutter thereby allowing unobstructed drainage of water within the rain gutter.

It is common for rain gutters and downspouts to become obstructed from debris such as leaves and dirt. To remove the debris, the user must either stand upon the roof or a ladder to clean out the debris with a garden hose or broom. This is extremely dangerous and sometimes leads to serious injury to the individual while attempting to clean the obstructed gutter or downspout. In addition, while attempting to clean the gutter with water, often times the wet leaves will accumulate within the downspout which is even harder to clean. Therefore, there is a need for a rain gutter cleaning system that does not require the user to have to manually clean leaves and other debris from within the gutter.

2. Description of the Prior Art

Rain gutter devices have been in use for years. Typically, rain gutter devices comprise a gutter attached to the edge of a roof for collecting rain water runoff from the roof. A downspout is connected to the bottom surface of the gutter generally at a lower end of the gutter for receiving the accumulated water.

Unfortunately, debris such as leaves and dirt can become accumulated within the gutter and the downspout thereby obstructing free flowing of the accumulated water. Since the water is unable to exit through the downspout, it overflows the edges of the gutter thereby penetrating the building structure thereby causing severe damage such as rotting to the building structure.

Examples of rain gutter cleaning devices include U.S. Pat. No. 5,709,051 to Mazziotti; U.S. Pat. No. 5,526,612 to Wade; U.S. Pat. No. 5,678,360 to Fort et al; U.S. Pat. No. 5,852,900 to Edelman; U.S. Pat. No. 5,791,091 to Barbera; U.S. Pat. No. 5,802,776 to Murray which are all illustrative of such prior art.

Mazziotti (U.S. Pat. No. 5,709,051) discloses a debris removal device for rain gutter downspouts. Mazziotti teaches an elongate tubular housing open on both ends and having an unobstructed third opening formed transversely through the tubular wall between the ends, and a partition having apertures formed therein extends within the tubular housings at an inclination.

Wade (U.S. Pat. No. 5,526,612) discloses a leaf free gutter and downpipe rain head. Wade teaches a box compartment having an upwardly facing included inlet over which a primary screen is located and a lower outlet connected to a downpipe through which the filtered water passes.

Fort et al (U.S. Pat. No. 5,678,360) discloses a gutter liquid separator. Fort teaches a debris discharge outlet and a liquid separator wherein the debris discharge includes a flow surface and an inner and outer wall.

While these devices may be suitable for the particular purpose to which they address, they are not as suitable for removing leaves and other debris from a conventional rain gutter thereby allowing unobstructed drainage of water within the rain gutter.

In these respects, the rain gutter cleaning assembly according to the present invention substantially departs from the conventional concepts and designs of the prior art, and in so doing provides an apparatus primarily developed for the purpose of removing leaves and other debris from a conventional rain gutter thereby allowing unobstructed drainage of water within the rain gutter.

SUMMARY OF THE INVENTION

In view of the foregoing disadvantages inherent in the known types of rain gutter cleaning devices now present in the prior art, the present invention provides a new rain gutter cleaning assembly construction wherein the same can be utilized for removing leaves and other debris from a conventional rain gutter thereby allowing unobstructed drainage of water within the rain gutter.

The general purpose of the present invention, which will be described subsequently in greater detail, is to provide a new rain gutter cleaning assembly that has many of the advantages of the rain gutter cleaning devices mentioned heretofore and many novel features that result in a new rain gutter cleaning assembly which is not anticipated, rendered obvious, suggested, or even implied by any of the prior art rain gutter cleaning devices, either alone or in any combination thereof.

To attain this, the present invention generally comprises a guide structure having an upper opening, a lower opening and a front opening. The upper opening of the guide structure mates with a gutter opening with the rain gutter. A plurality of prongs are positioned within the guide structure and are inclined toward the front opening and extend outwardly through the front opening a finite distance. A funnel structure is attachable to the lower opening of the guide structure for connecting to a conventional downspout. In operation, when leaves accumulate within the rain gutter the wind blows the dried leaves about the rain gutter. When the leaves approach the gutter opening, they fall through the guide structure and slide upon the plurality of prongs out through the front opening thereby not allowing the leaves to obstruct the downspout. During rainy conditions, the water within the rain gutter flows toward the gutter opening. As the water flows through the gutter opening it passes through the plurality of prongs into the downspout free of the debris that is separated from the water by the prongs.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a rain gutter cleaning assembly that will overcome the shortcomings of the prior art devices.

Another object is to provide a rain gutter cleaning assembly that automatically removes leaves and other debris from a gutter prior to entering a downspout.

An additional object is to provide a rain gutter cleaning assembly that reduces the number of times an individual must manually clean a gutter system.

A further object is to provide a rain gutter cleaning assembly that removes debris during both dry and wet conditions.

Another object is to provide a rain gutter cleaning assembly that is attachable to most designs of rain gutter systems.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
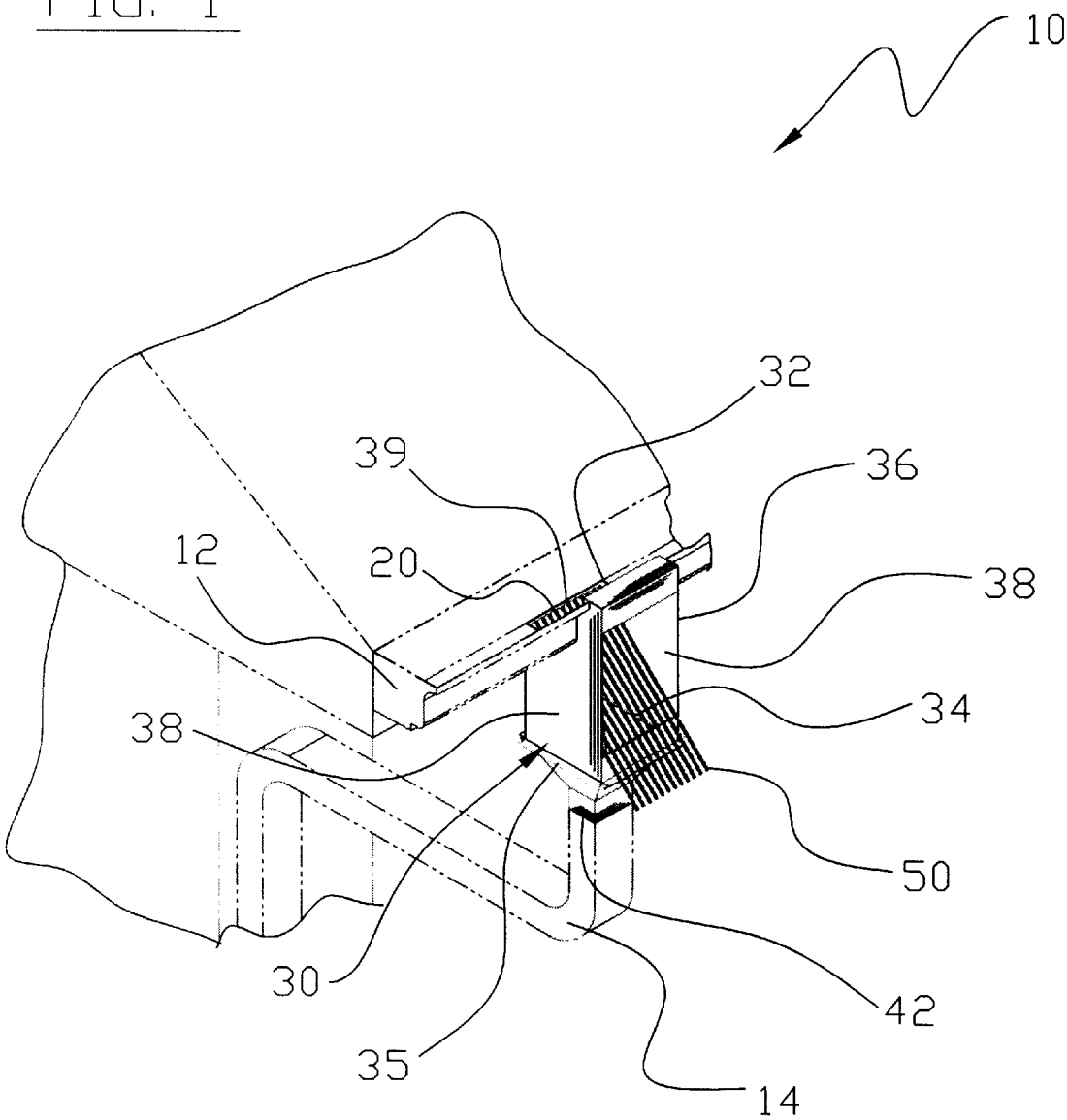
FIG. 1 is an upper perspective view of the present invention attached to a conventional rain gutter.

Turning now descriptively to the drawings, in which similar reference characters denote similar elements throughout the several view, FIGS. 1 through 4 illustrate a rain gutter cleaning assembly 10, which comprises a guide structure 30 having an upper opening 32, a lower opening 34 and a front opening 36. The upper opening 32 of the guide structure 30 mates with a gutter opening 20 with the rain gutter 12. A plurality of prongs 50 are positioned within the guide structure 30 and are inclined toward the front opening 36 and extend outwardly through the front opening 36 a finite distance. A funnel structure 40 is attachable to the lower opening 34 of the guide structure 30 for connecting to a conventional downspout 14. In operation, when leaves accumulate within the rain gutter 12 the wind blows the dried leaves about the rain gutter 12. When the leaves approach the gutter opening 20, they fall through the guide structure 30 and slide upon the plurality of prongs 50 out through the front opening 36 thereby not allowing the leaves to obstruct the downspout 14. During rainy conditions, the water within the rain gutter 12 flows toward the gutter opening 20. As the water flows through the gutter opening 20 it passes through the plurality of prongs 50 into the downspout 14 free of the debris that is separated from the water by the prongs 50.

Figure 2:
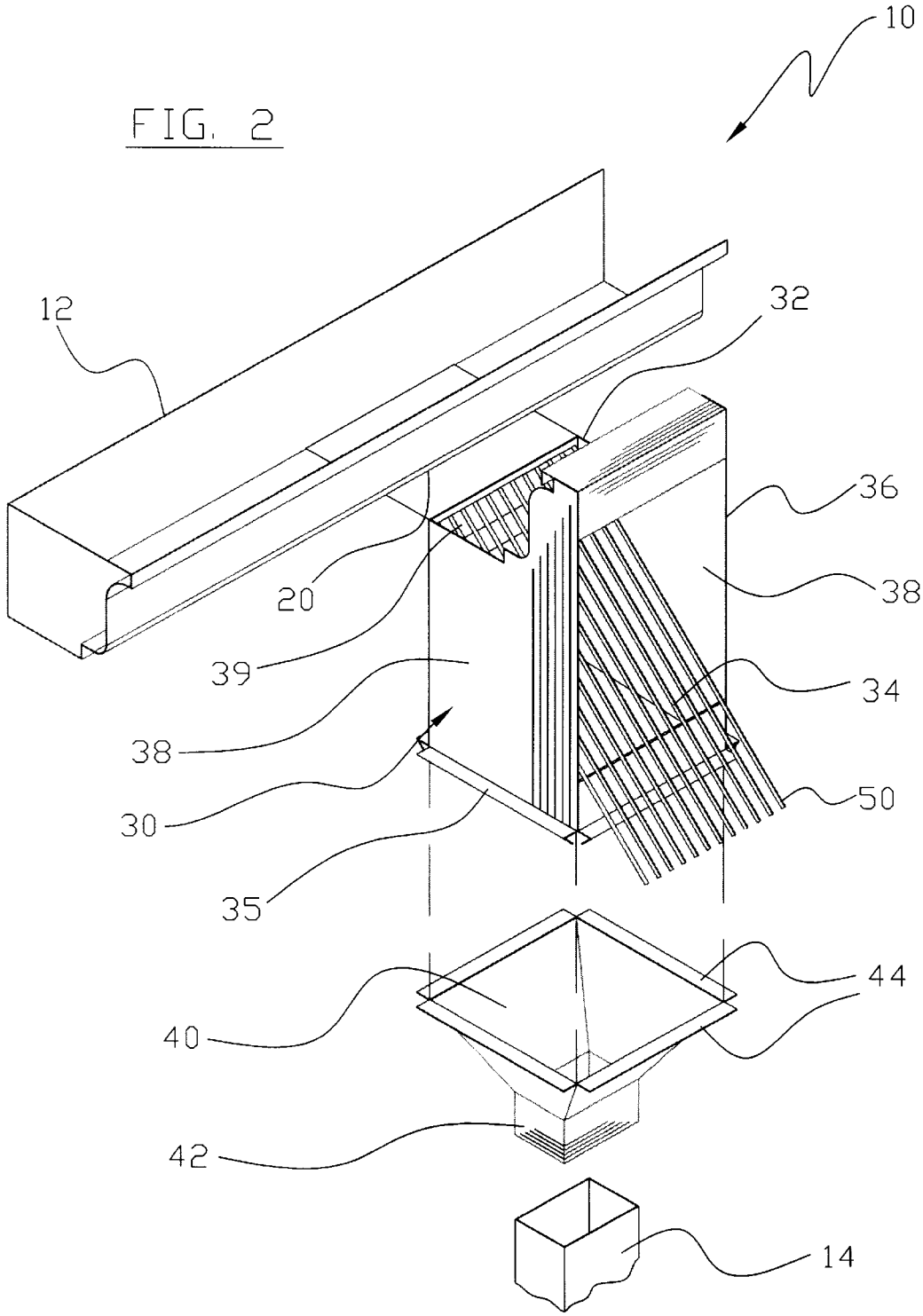
FIG. 2 is an exploded upper perspective view of the present invention.

As best shown in FIGS. 1 and 2 of the drawings, the guide structure 30 comprises a pair of side walls 38, a rear wall 39, an upper opening 32, a lower opening 34 and a front opening 36. The upper opening 32 is formed to the shape of the rain gutter 12 and mates with a gutter opening 20 within the rain gutter 12. The gutter opening 20 is larger than the size of a downspout 14 for allowing large objects to flow through without obstruction. A rim engaging member 35 extends from the lower opening 34 for engaging a funnel structure 40.

As shown in FIGS. 1 through 4 of the drawings, a plurality of prongs 50 are attached to the rear wall 39 of the guide structure 30. The plurality of prongs 50 are angled downwardly from the rear wall 39 out through the front opening 36 a finite distance as shown in FIGS. 1 and 2 of the drawings. The prongs 50 are distally spaced apart a finite distance for allowing water to freely pass through while significantly reducing the amount of debris that is able to flow through the downspout 14.

Figure 3:
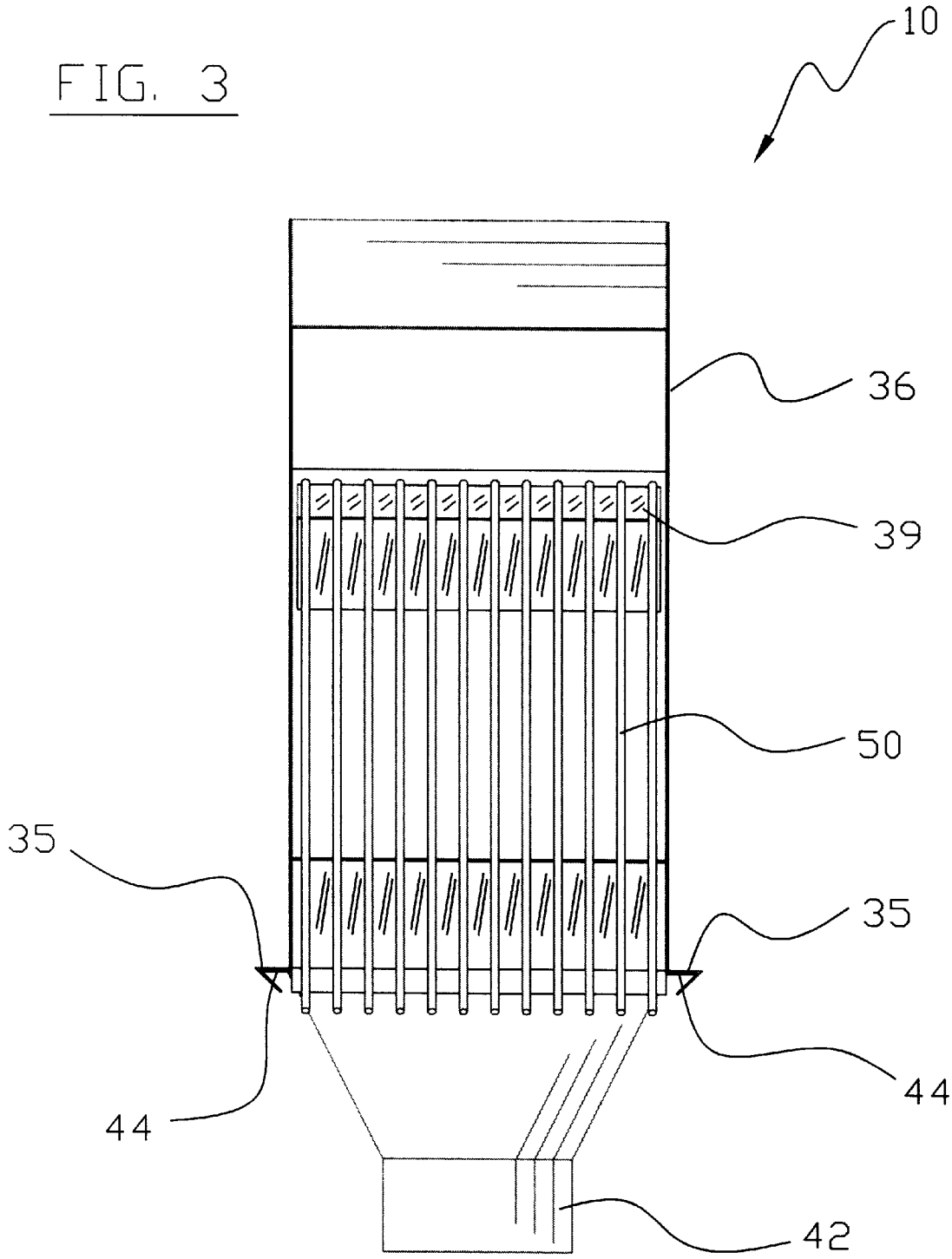
FIG. 3 is a front view of the present invention.
Figure 4:
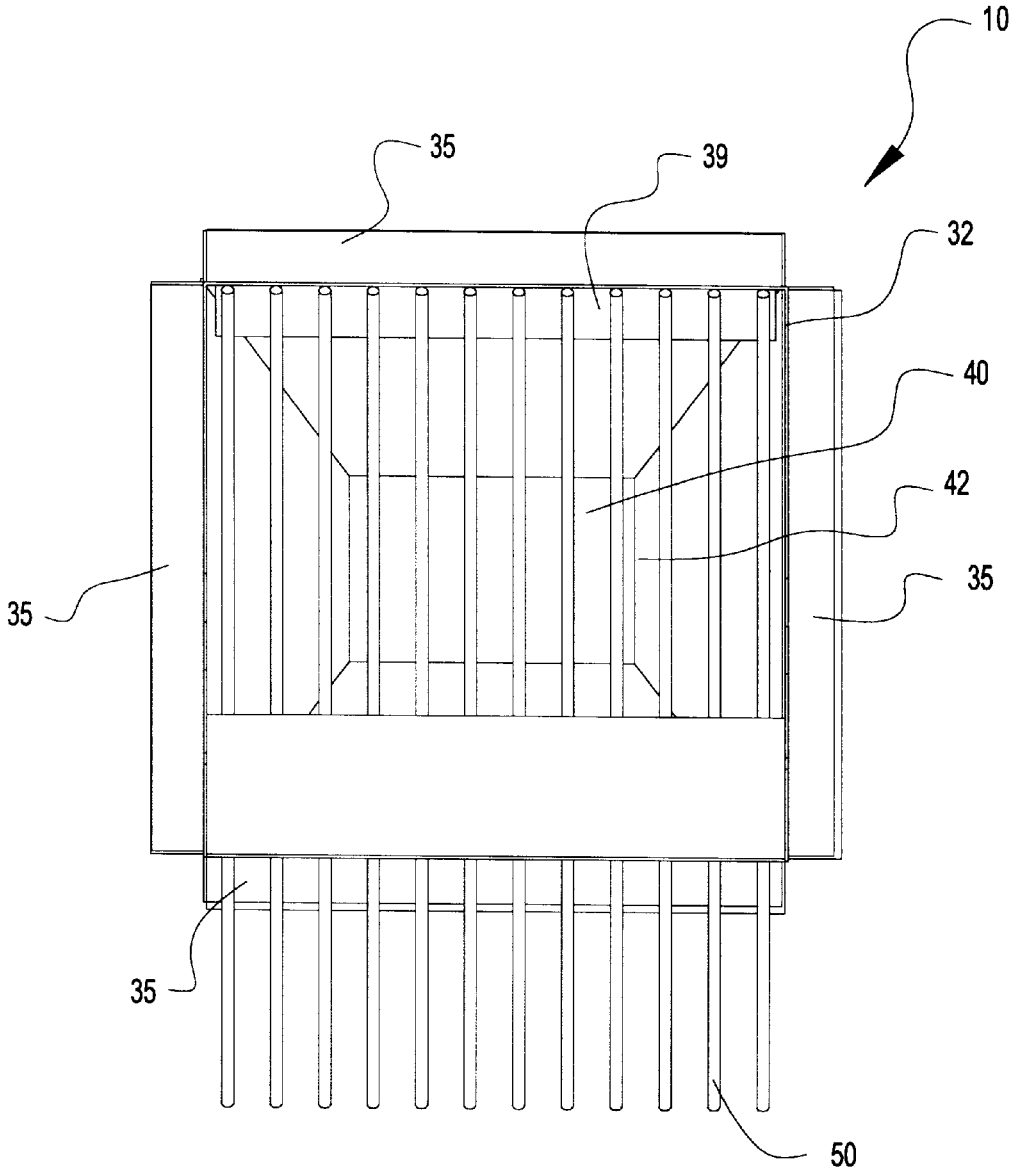
FIG. 4 is a top view of the present invention.

As shown in FIGS. 1 through 3 of the drawings, the funnel structure 40 has a lip 44 that is enageable within the rim engaging member 35 of the guide structure 30. The funnel structure 40 tapers from the lower opening 34 to a reducer tube 42 that removably mates with a conventional downspout 14.

In use, if the user is attaching the invention to an existing rain gutter 12, the user must cut a larger gutter opening 20 within the rain gutter 12 to the size of the upper opening 32 of the guide structure 30. The guide structure 30 is trimmed to accommodate the outer shape of the rain gutter 12. The user then attaches the guide structure 30 to the rain gutter 12 about the gutter opening 20 by a conventional attaching means for capturing water that flows through the rain gutter 12 into the gutter opening 20. The user then trims the length of the downspout 14 to the appropriate length so as to mate with the reducer tube 42 of the funnel structure 40. In operation, when leaves accumulate within the rain gutter 12 the wind blows the dried leaves about the rain gutter 12. When the leaves approach the gutter opening 20, they fall through the guide structure 30 and slide upon the plurality of prongs 50 out through the front opening 36 thereby not allowing the leaves to obstruct the downspout 14. During rainy conditions, the water within the rain gutter 12 flows toward the gutter opening 20. As the water flows through the gutter opening 20 it passes through the plurality of prongs 50 into the downspout 14 free of the debris that is separated from the water by the prongs 50.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rain gutter cleaning assembly, comprising:

a guide structure having an upper opening, a lower opening and a front opening, wherein said guide structure is attachable to a gutter opening within a rain gutter having a shape, wherein said upper opening of said guide structure is adapted to conform to said shape of said rain gutter; and a deflector structure secured within said guide structure angled downwardly toward said front opening.

2. The rain gutter cleaning assembly of claim 1, wherein said guide structure includes:

a pair of side walls; and a rear wall secured between said pair of side walls.

3. The rain gutter cleaning assembly of claim 1, including a funnel structure attached to said guide structure about the lower opening wherein said funnel structure is attachable to a downspout.

4. The rain gutter cleaning assembly of claim 3, wherein said gutter opening is substantially larger than a cross section of said downspout.

5. The rain gutter cleaning assembly of claim 3, wherein said funnel structure includes a lip that is engaged to a rim engaging member of said guide structure.

6. The rain gutter cleaning assembly of claim 5, wherein said funnel structure includes a reducer tube that is attachable to said downspout.

7. The rain gutter cleaning assembly of claim 1, wherein said deflector structure comprises a plurality of prongs distally spaced apart.

8. The rain gutter cleaning assembly of claim 7, wherein said plurality of prongs extend a finite distance outward from said guide structure.

9. The rain gutter cleaning assembly of claim 7, wherein said plurality of prongs are secured to a rear wall of said guide structure.

10. A rain gutter cleaning assembly, comprising:

a guide structure having an upper opening, a lower opening and a front opening, wherein said guide structure is attachable to a gutter opening within a rain gutter having a shape, wherein said upper opening of said guide structure is adapted to conform to said shape of said rain gutter;

a deflector structure secured within said guide structure angled downwardly toward said front opening; and a tapering funnel structure attached to said guide structure about said lower opening wherein said funnel structure is attachable to a downspout.

11. The rain gutter cleaning assembly of claim 10, wherein said gutter opening is substantially larger than a cross section of said downspout.

12. The rain gutter cleaning assembly of claim 10, wherein said guide structure includes:

a pair of side walls; and a rear wall secured between said pair of side walls.

13. The rain gutter cleaning assembly of claim 10, wherein said funnel structure includes a lip that is engaged to a rim engaging member of said guide structure.

14. The rain gutter cleaning assembly of claim 10, wherein said funnel structure includes a reducer tube that is attachable to said downspout.

15. The rain gutter cleaning assembly of claim 10, wherein said deflector structure comprises a plurality of prongs distally spaced apart.

16. The rain gutter cleaning assembly of claim 15, wherein said plurality of prongs extend a finite distance outward from said guide structure.

17. The rain gutter cleaning assembly of claim 15, wherein said plurality of prongs are secured to a rear wall of said guide structure.

18. A rain gutter cleaning assembly, comprising:

a guide structure having an upper opening, a lower opening and a front opening, wherein said guide structure is attachable to a gutter opening within a rain gutter having a shape and wherein said gutter opening is larger than a cross section of a downspout;

a deflector structure secured within said guide structure angled downwardly toward said front opening, wherein said deflector structure comprises a plurality of prongs distally spaced apart and wherein said plurality of prongs extend a finite distance outward from said guide structure; and a funnel structure attached to the guide structure about the lower opening wherein said funnel structure is attachable to said downspout;

wherein said upper opening of said guide structure is adapted to conform to said shape of said rain gutter.

19. The rain gutter cleaning assembly of claim 18, wherein said funnel structure is tapered.

* * * * *